US011468873B2

(12) United States Patent
Cho et al.

(10) Patent No.: US 11,468,873 B2
(45) Date of Patent: Oct. 11, 2022

(54) GRADUAL RESET OF FILTER COEFFICIENTS IN AN ADAPTIVE NOISE CANCELLATION SYSTEM

(71) Applicant: Cirrus Logic International Semiconductor Ltd., Edinburgh (GB)

(72) Inventors: Sang-Ik Cho, Austin, TX (US); Dayong Zhou, Austin, TX (US)

(73) Assignee: Cirrus Logic, Inc., Austin, TX (US)

( * ) Notice: Subject to any disclaimer, the term of this patent is extended or adjusted under 35 U.S.C. 154(b) by 454 days.

(21) Appl. No.: 15/720,407

(22) Filed: Sep. 29, 2017

(65) Prior Publication Data

US 2019/0103090 A1 Apr. 4, 2019

(51) Int. Cl.
*G10K 11/178* (2006.01)

(52) U.S. Cl.
CPC ..... *G10K 11/178* (2013.01); *G10K 11/1783* (2018.01); *G10K 11/17833* (2018.01); *G10K 11/17835* (2018.01); *G10K 11/17854* (2018.01); *G10K 11/17881* (2018.01); *G10K 11/17885* (2018.01); *G10K 2210/108* (2013.01); *G10K 2210/1081* (2013.01); *G10K 2210/1082* (2013.01); *G10K 2210/129* (2013.01); *G10K 2210/12821* (2013.01); *G10K 2210/3014* (2013.01); *G10K 2210/30231* (2013.01); *G10K 2210/503* (2013.01)

(58) Field of Classification Search
CPC ..... G10K 11/178; G10K 2210/1082; G10K 2210/129; G10K 2210/3014; G10K 2210/1081; G10K 2210/12821; G10K 2210/30391; G10K 11/1783; G10K 11/17833
See application file for complete search history.

(56) References Cited

U.S. PATENT DOCUMENTS 8,949,120 B1 2/2015 Every et al.
2011/0142247 A1* 6/2011 Fellers ..... G10K 11/178 381/71.1

(Continued)

FOREIGN PATENT DOCUMENTS

EP 0631383 A2 12/1994

OTHER PUBLICATIONS

Combined Search and Examination Report, UKIPO, Application No. GB1719323.6, dated May 3, 2018.

(Continued)

*Primary Examiner* — Ping Lee
(74) *Attorney, Agent, or Firm* — Jackson Walker L.L.P.

(57) ABSTRACT

An integrated circuit for implementing at least a portion of a personal audio device may include a processing circuit to implement an adaptive filter having a response that generates an anti-noise signal to reduce the presence of the ambient audio sounds at an error microphone, implement a coefficient control block that shapes the response of the adaptive filter in conformity with the error microphone signal by computing coefficients that determine the response of the adaptive filter to minimize the ambient audio sounds at the error microphone, and responsive to detecting a condition that triggers a reset of the adaptive filter, increment the coefficients in a plurality of steps from initial values of the coefficients at a time of triggering the reset to final values of the coefficients at a conclusion of the reset.

22 Claims, 5 Drawing Sheets

(56) References Cited

U.S. PATENT DOCUMENTS

| | | | | |
|---|---|---|---|---|
| 2012/0308026 | A1* | 12/2012 | Kamath | G10K 11/178<br>381/71.11 |
| 2013/0287219 | A1* | 10/2013 | Hendrix | G10K 11/175<br>381/71.6 |
| 2016/0260423 | A1 | 9/2016 | Rosenkranz et al. | |

OTHER PUBLICATIONS

Examination Report, UKIPO, Application No. GB1719323.6, dated Jun. 1, 2020.
Examination Report, UKIPO, Application No. GB1719323.6, dated Nov. 17, 2020.

* cited by examiner

GRADUAL RESET OF FILTER COEFFICIENTS IN AN ADAPTIVE NOISE CANCELLATION SYSTEM

FIELD OF DISCLOSURE

The present disclosure relates in general to adaptive noise cancellation in connection with an acoustic transducer, and more particularly, to resetting filter coefficients of an adaptive noise cancellation system in a manner that minimizes audible artifacts.

BACKGROUND

Wireless telephones, such as mobile/cellular telephones, cordless telephones, and other consumer audio devices, such as mp3 players, are in widespread use. Performance of such devices with respect to intelligibility can be improved by providing noise cancelling using a microphone to measure ambient acoustic events and then using signal processing to insert an anti-noise signal into the output of the device to cancel the ambient acoustic events.

An active noise cancellation (ANC) system achieves the suppression of noise by observing the ambient noise with one or more microphones and processing the noise signal with digital filters to generate an anti-noise signal, which is then played through a loudspeaker. The application of active noise cancellation to personal audio devices such as wireless telephones and headphones is intended to enhance the users' listening experience with respect to intelligibility and isolation from the ambient noise. Because the acoustic environment around personal audio devices can change depending on the noise sources that are present and the position or fitting condition of the device itself, an active noise cancellation system can be implemented with adaptive filters in order to adapt the anti-noise to take such environmental changes into account. An oversight control mechanism, such as one described in U.S. Pat. No. 9,633,646, is designed such that the adaptive filters in such ANC system remain stable in the presence of various acoustic events that may hinder stable adaptation. The oversight system may detect suboptimal conditions that are disruptive to filter adaptation and freeze the filter coefficients for a set duration until the conditions have subsided. The oversight system may also detect a non-ideal state (e.g., a divergent state) of filter coefficients and reset them to zero or a pre-stored set of coefficients. Resetting the coefficients is an effective way to restore a filter to a known, good state. However, an instantaneous filter reset may introduce a sharp discontinuity in the output signal of the filter and is therefore often reserved as the last preferred action to be taken only to recover the system before a serious misbehavior. In the case of an adaptive feedforward ANC filter, a reset often causes a listener-perceptible audible artifact (e.g., a pop or click) due to the discontinuity in the anti-noise output, potentially leading to an undesirable listening experience.

SUMMARY

In accordance with the teachings of the present disclosure, certain disadvantages and problems associated with existing approaches to feedback adaptive noise cancellation may be reduced or eliminated.

In accordance with embodiments of the present disclosure, an integrated circuit for implementing at least a portion of a personal audio device may include an output, an error microphone, and a processing circuit. The output may be configured to provide a signal to a transducer including both a source audio signal for playback to a listener and an anti-noise signal for countering the effects of ambient audio sounds in an acoustic output of the transducer. The error microphone input may be configured to receive an error microphone signal indicative of the output of the transducer and the ambient audio sounds at the transducer. The processing circuit may be configured to implement an adaptive filter having a response that generates the anti-noise signal to reduce the presence of the ambient audio sounds at the error microphone, implement a coefficient control block that shapes the response of the adaptive filter in conformity with the error microphone signal by computing coefficients that determine the response of the adaptive filter to minimize the ambient audio sounds at the error microphone, and responsive to detecting a condition that triggers a reset of the adaptive filter, increment the coefficients in a plurality of steps from initial values of the coefficients at a time of triggering the reset to final values of the coefficients at a conclusion of the reset.

In accordance with these and other embodiments of the present disclosure, a method may include receiving an error microphone signal indicative of the output of the transducer and ambient audio sounds at the transducer and generating an anti-noise signal for countering the effects of ambient audio sounds at an acoustic output of the transducer, wherein generating the anti-noise signal comprises implementing an adaptive filter having a response that generates the anti-noise signal to reduce the presence of the ambient audio sounds at the error microphone and implementing a coefficient control block that shapes the response of the adaptive filter in conformity with the error microphone signal by computing coefficients that determine the response of the adaptive filter to minimize the ambient audio sounds at the error microphone. The method may also include, responsive to detecting a condition that triggers a reset of the adaptive filter, incrementing the coefficients in a plurality of steps from initial values of the coefficients at a time of triggering the reset to final values of the coefficients at a conclusion of the reset. The method may further include combining the anti-noise signal with a source audio signal to generate an audio signal provided to the transducer.

Technical advantages of the present disclosure may be readily apparent to one of ordinary skill in the art from the figures, description and claims included herein. The objects and advantages of the embodiments will be realized and achieved at least by the elements, features, and combinations particularly pointed out in the claims.

It is to be understood that both the foregoing general description and the following detailed description are examples and explanatory and are not restrictive of the claims set forth in this disclosure.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

The present disclosure encompasses noise cancelling techniques and circuits that can be implemented in a personal audio device, such as a wireless telephone. The personal audio device includes an ANC circuit that may measure the ambient acoustic environment and generate a signal that is injected in the speaker (or other transducer) output to cancel ambient acoustic events. A reference microphone may be provided to measure the ambient acoustic environment and an error microphone may be included for controlling the adaptation of the anti-noise signal to cancel the ambient audio sounds and for correcting for the electro-acoustic path from the output of the processing circuit through the transducer.

Figure 1A:
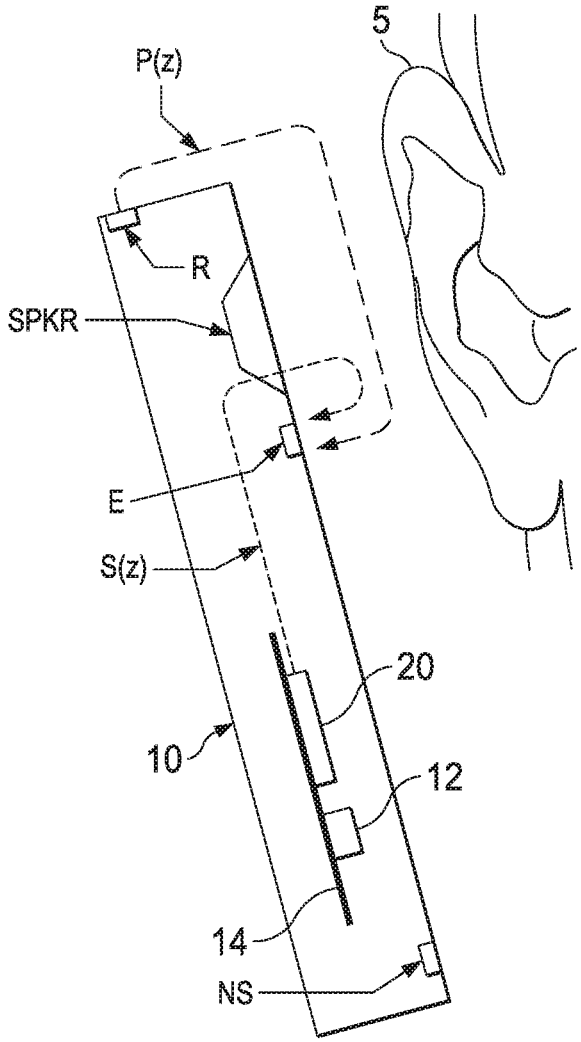
FIG. 1A is an illustration of an example wireless mobile telephone, in accordance with embodiments of the present disclosure.

Referring now to FIG. 1A, a wireless telephone 10 as illustrated in accordance with embodiments of the present disclosure is shown in proximity to a human ear 5. Wireless telephone 10 is an example of a device in which techniques in accordance with embodiments of this disclosure may be employed, but it is understood that not all of the elements or configurations embodied in illustrated wireless telephone 10, or in the circuits depicted in subsequent illustrations, are required in order to practice the inventions recited in the claims. Wireless telephone 10 may include a transducer such as speaker SPKR that reproduces distant speech received by wireless telephone 10, along with other local audio events such as ringtones, stored audio program material, injection of near-end speech (i.e., the speech of the user of wireless telephone 10) to provide a balanced conversational perception, and other audio that requires reproduction by wireless telephone 10, such as sources from webpages or other network communications received by wireless telephone 10 and audio indications such as a low battery indication and other system event notifications. A near-speech microphone NS may be provided to capture near-end speech, which is transmitted from wireless telephone 10 to the other conversation participant(s).

Wireless telephone 10 may include ANC circuits and features that inject an anti-noise signal into speaker SPKR to improve intelligibility of the distant speech and other audio reproduced by speaker SPKR. A reference microphone R may be provided for measuring the ambient acoustic environment, and may be positioned away from the typical position of a user's mouth, so that the near-end speech may be minimized in the signal produced by reference microphone R. Another microphone, error microphone E, may be provided in order to further improve the ANC operation by providing a measure of the ambient audio combined with the audio reproduced by speaker SPKR close to ear 5, when wireless telephone 10 is in close proximity to ear 5. In other embodiments, additional reference and/or error microphones may be employed. Circuit 14 within wireless telephone 10 may include an audio CODEC integrated circuit (IC) 20 that receives the signals from reference microphone R, near-speech microphone NS, and error microphone E and interfaces with other integrated circuits such as a radio-frequency (RF) integrated circuit 12 having a wireless telephone transceiver. In some embodiments of the disclosure, the circuits and techniques disclosed herein may be incorporated in a single integrated circuit that includes control circuits and other functionality for implementing the entirety of the personal audio device, such as an MP3 player-on-a-chip integrated circuit. In these and other embodiments, the circuits and techniques disclosed herein may be implemented partially or fully in software and/or firmware embodied in computer-readable media and executable by a controller or other processing device.

In general, ANC techniques of the present disclosure measure ambient acoustic events (as opposed to the output of speaker SPKR and/or the near-end speech) impinging on reference microphone R, and by also measuring the same ambient acoustic events impinging on error microphone E, ANC processing circuits of wireless telephone 10 adapt an anti-noise signal generated from the output of reference microphone R to have a characteristic that minimizes the amplitude of the ambient acoustic events at error microphone E. Because acoustic path P(z) extends from reference microphone R to error microphone E, ANC circuits are effectively estimating acoustic path P(z) while removing effects of an electro-acoustic path S(z) that represents the response of the audio output circuits of CODEC IC 20 and the acoustic/electric transfer function of speaker SPKR including the coupling between speaker SPKR and error microphone E in the particular acoustic environment, which may be affected by the proximity and structure of ear 5 and other physical objects and human head structures that may be in proximity to wireless telephone 10, when wireless telephone 10 is not firmly pressed to ear 5. While the illustrated wireless telephone 10 includes a two-microphone ANC system with a third near-speech microphone NS, some aspects of the present invention may be practiced in a system that does not include separate error and reference microphones, or a wireless telephone that uses near-speech microphone NS to perform the function of the reference microphone R. Also, in personal audio devices designed only for audio playback, near-speech microphone NS will generally not be included, and the near-speech signal paths in the circuits described in further detail below may be omitted, without changing the scope of the disclosure, other than to limit the options provided for input to the microphone.

Figure 1B:
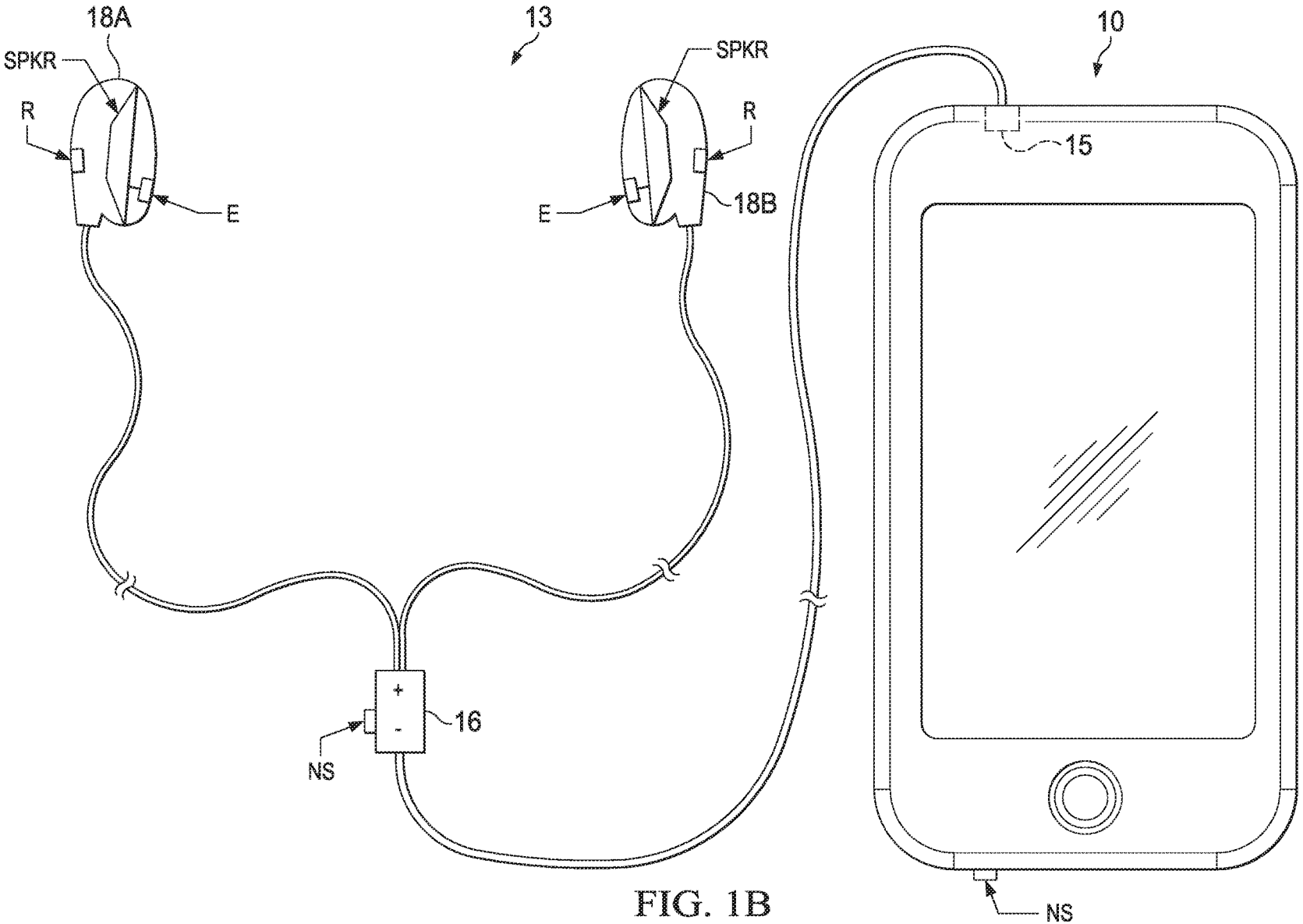
FIG. 1B is an illustration of an example wireless mobile telephone with a headphone assembly coupled thereto, in accordance with embodiments of the present disclosure.

Referring now to FIG. 1B, wireless telephone 10 is depicted having a headphone assembly 13 coupled to it via audio port 15. Audio port 15 may be communicatively coupled to RF integrated circuit 12 and/or CODEC IC 20, thus permitting communication between components of headphone assembly 13 and one or more of RF integrated circuit 12 and/or CODEC IC 20. As shown in FIG. 1B, headphone assembly 13 may include a combox 16, a left headphone 18A, and a right headphone 18B. In some embodiments, headphone assembly 13 may comprise a wireless headphone assembly, in which case all or some portions of CODEC IC 20 may be present in headphone assembly 13, and headphone assembly 13 may include a wireless communication interface (e.g., BLUETOOTH) in order to communicate between headphone assembly 13 and wireless telephone 10.

As used in this disclosure, the term "headphone" broadly includes any loudspeaker and structure associated therewith that is intended to be mechanically held in place proximate to a listener's ear canal, and includes without limitation earphones, earbuds, and other similar devices. As more specific examples, "headphone" may refer to intra-concha earphones, supra-concha earphones, and supra-aural earphones.

Combox 16 or another portion of headphone assembly 13 may have a near-speech microphone NS to capture near-end speech in addition to or in lieu of near-speech microphone NS of wireless telephone 10. In addition, each headphone 18A, 18B may include a transducer such as speaker SPKR that reproduces distant speech received by wireless telephone 10, along with other local audio events such as ringtones, stored audio program material, injection of near-end speech (i.e., the speech of the user of wireless telephone 10) to provide a balanced conversational perception, and other audio that requires reproduction by wireless telephone 10, such as sources from webpages or other network communications received by wireless telephone 10 and audio indications such as a low battery indication and other system event notifications. Each headphone 18A, 18B may include a reference microphone R for measuring the ambient acoustic environment and an error microphone E for measuring of the ambient audio combined with the audio reproduced by speaker SPKR close to a listener's ear when such headphone 18A, 18B is engaged with the listener's ear. In some embodiments, CODEC IC 20 may receive the signals from reference microphone R and error microphone E of each headphone and near-speech microphone NS, and perform adaptive noise cancellation for each headphone as described herein. In other embodiments, a CODEC IC or another circuit may be present within headphone assembly 13, communicatively coupled to reference microphone R, near-speech microphone NS, and error microphone E, and configured to perform adaptive noise cancellation as described herein.

Figure 2:
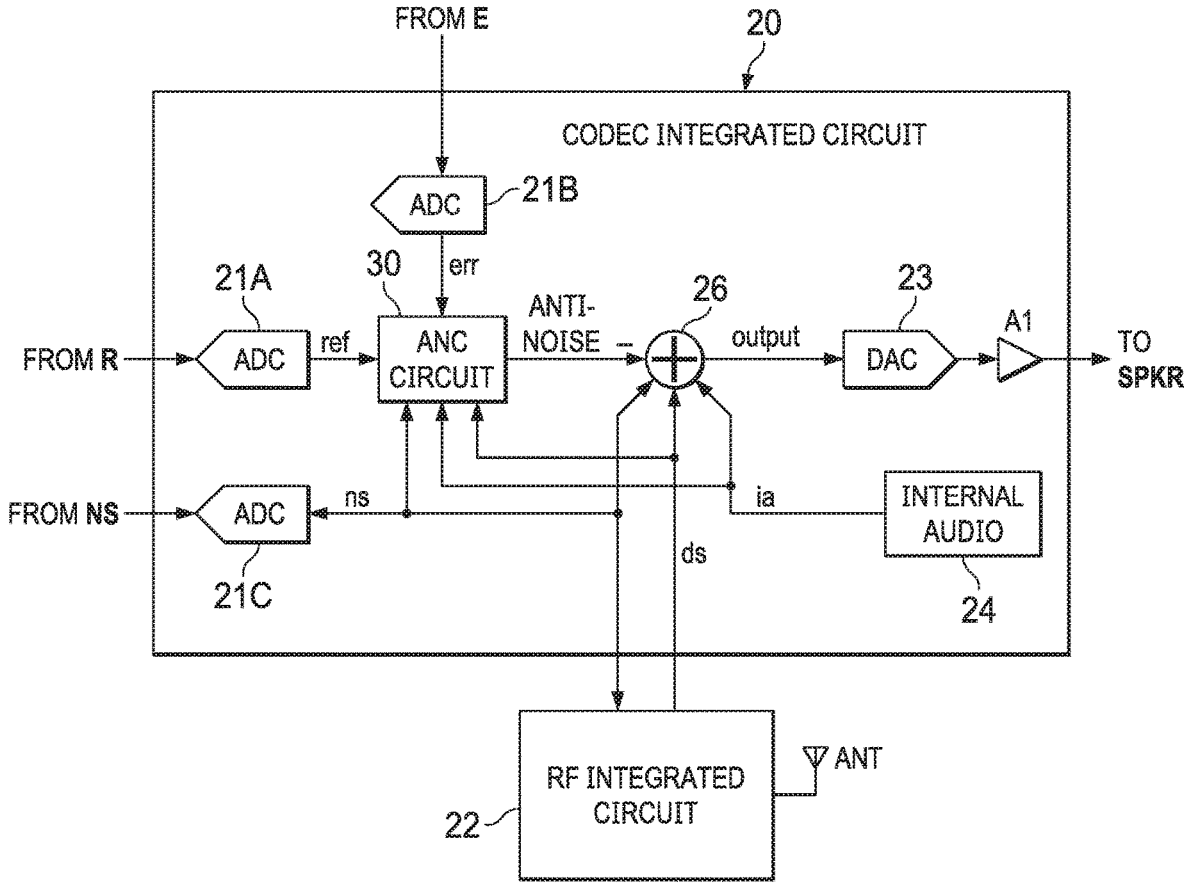
FIG. 2 is a block diagram of selected circuits within the wireless mobile telephone depicted in FIG. 1A, in accordance with embodiments of the present disclosure.

Referring now to FIG. 2, selected circuits within wireless telephone 10 are shown in a block diagram, which in other embodiments may be placed in whole or in part in other locations such as one or more headphones or earbuds. CODEC IC 20 may include an analog-to-digital converter (ADC) 21A for receiving the reference microphone signal from microphone R and generating a digital representation ref of the reference microphone signal, an ADC 21B for receiving the error microphone signal from error microphone E and generating a digital representation err of the error microphone signal, and an ADC 21C for receiving the near speech microphone signal from near speech microphone NS and generating a digital representation ns of the near speech microphone signal. CODEC IC 20 may generate an output for driving speaker SPKR from an amplifier A1, which may amplify the output of a digital-to-analog converter (DAC) 23 that receives the output of a combiner 26. Combiner 26 may combine audio signals is from internal audio sources 24, the anti-noise signal generated by ANC circuit 30, which by convention has the same polarity as the noise in reference microphone signal ref and is therefore subtracted by combiner 26, and a portion of near speech microphone signal ns so that the user of wireless telephone 10 may hear his or her own voice in proper relation to downlink speech ds, which may be received from radio frequency (RF) integrated circuit 22 and may also be combined by combiner 26. Near speech microphone signal ns may also be provided to RF integrated circuit 22 and may be transmitted as uplink speech to the service provider via antenna ANT.

Figure 3:
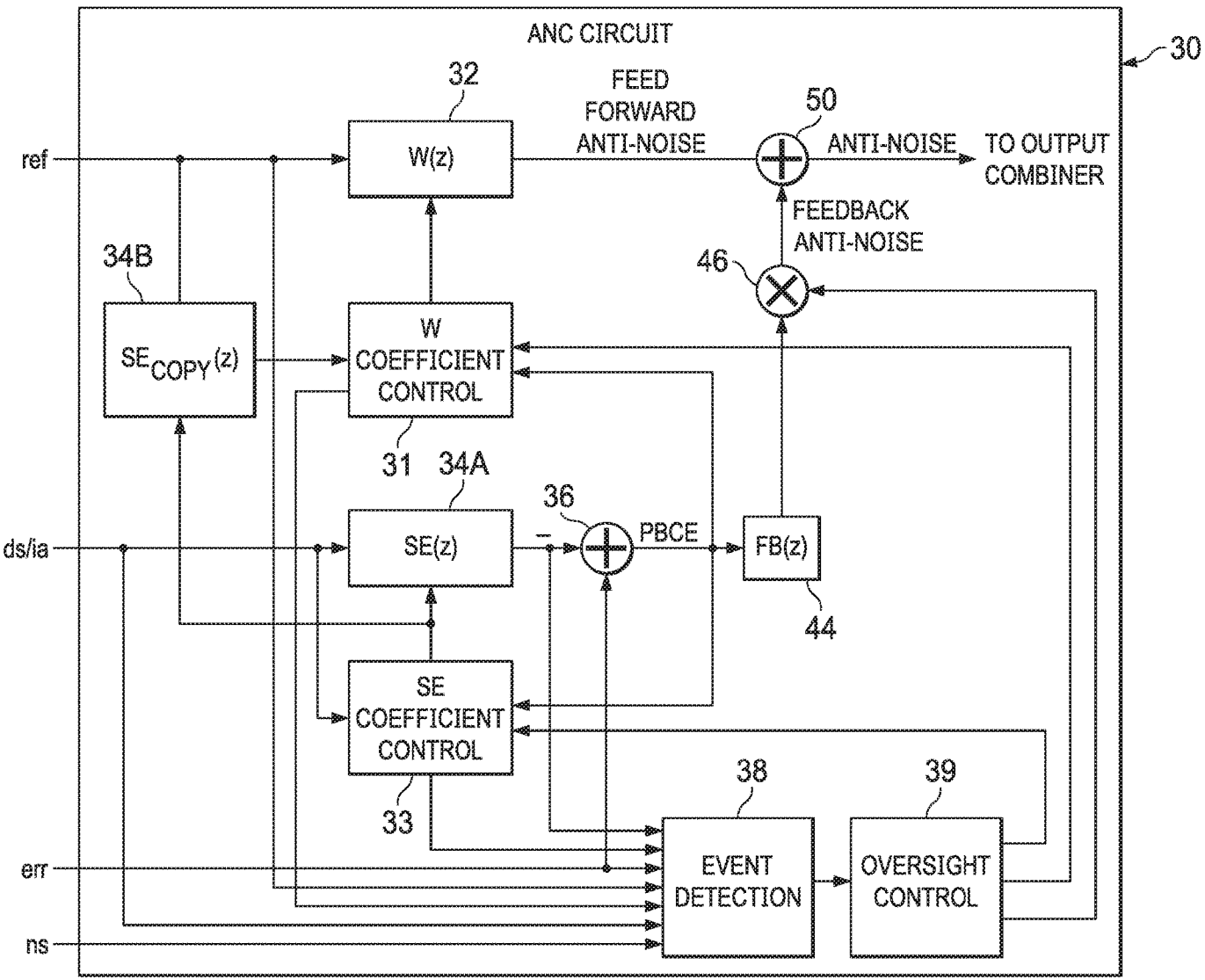
FIG. 3 is a block diagram depicting selected signal processing circuits and functional blocks within an example adaptive noise cancelling (ANC) circuit of a coder-decoder (CODEC) integrated circuit of FIG. 2 which uses feedforward filtering to generate an anti-noise signal, in accordance with embodiments of the present disclosure.

Referring now to FIG. 3, details of ANC circuit 30 which may be used to implement ANC circuit 30 are shown in accordance with embodiments of the present disclosure. Adaptive filter 32 may receive reference microphone signal ref and under ideal circumstances, may adapt its transfer function W(z) to be P(z)/S(z) to generate a feedforward anti-noise component of the anti-noise signal, which may be combined by combiner 50 with a feedback anti-noise component of the anti-noise signal (described in greater detail below) to generate an anti-noise signal which in turn may be provided to an output combiner that combines the anti-noise signal with the source audio signal to be reproduced by the transducer, as exemplified by combiner 26 of FIG. 2. The coefficients of adaptive filter 32 may be controlled by a W coefficient control block 31 that uses a correlation of signals to determine the response of adaptive filter 32, which generally minimizes the error, in a least-mean squares sense, between those components of reference microphone signal ref present in error microphone signal err. The signals compared by W coefficient control block 31 may be the reference microphone signal ref as shaped by a copy of an estimate of the response of path S(z) provided by filter 34B and another signal that includes error microphone signal err. By transforming reference microphone signal ref with a copy of the estimate of the response of path S(z), response $SE_{COPY}(z)$, and minimizing the ambient audio sounds in the error microphone signal, adaptive filter 32 may adapt to the desired response of P(z)/S(z). In addition to error microphone signal err, the signal compared to the output of filter 34B by W coefficient control block 31 may include an inverted amount of downlink audio signal ds and/or internal audio signal ia that has been processed by filter response SE(z), of which response $SE_{COPY}(z)$ is a copy. By injecting an inverted amount of downlink audio signal ds and/or internal audio signal ia, adaptive filter 32 may be prevented from adapting to the relatively large amount of downlink audio and/or internal audio signal present in error microphone signal err. However, by transforming that inverted copy of downlink audio signal ds and/or internal audio signal ia with the estimate of the response of path S(z), the downlink audio and/or internal audio that is removed from error microphone signal err should match the expected version of downlink audio signal ds and/or internal audio signal ia reproduced at error microphone signal err, because the electrical and acoustical path of S(z) is the path taken by downlink audio signal ds and/or internal audio signal ia to arrive at error microphone E. Filter 34B may not be an adaptive filter, per se, but may have an adjustable response that is tuned to match the response of adaptive filter 34A, so that the response of filter 34B tracks the adapting of adaptive filter 34A.

To implement the above, adaptive filter 34A may have coefficients controlled by SE coefficient control block 33, which may compare downlink audio signal ds and/or internal audio signal ia and error microphone signal err after removal of the above-described filtered downlink audio signal ds and/or internal audio signal ia, that has been filtered by adaptive filter 34A to represent the expected downlink audio delivered to error microphone E, and which is removed from the output of adaptive filter 34A by a combiner 36 to generate a playback-corrected error, shown as PBCE in FIG. 3. SE coefficient control block 33 may correlate the actual downlink speech signal ds and/or internal audio signal ia with the components of downlink audio signal ds and/or internal audio signal ia that are present in error microphone signal err. Adaptive filter 34A may thereby be adapted to generate a signal from downlink audio signal ds and/or internal audio signal ia, that when subtracted from error microphone signal err, contains the content of error microphone signal err that is not due to downlink audio signal ds and/or internal audio signal ia.

As depicted in FIG. 3, ANC circuit 30 may also comprise feedback filter 44. Feedback filter 44 may receive the playback corrected error signal PBCE and may apply a response FB(z) to generate a feedback signal based on the playback corrected error. Also as depicted in FIG. 3, a path of the feedback anti-noise component may have a programmable gain element 46 in series with feedback filter 44 such that the product of response FB(z) and a gain of programmable gain element 46 is applied to playback corrected error signal PBCE in order to generate the feedback anti-noise component of the anti-noise signal. The feedback anti-noise component of the anti-noise signal may be combined by combiner 50 with the feedforward anti-noise component of the anti-noise signal to generate the anti-noise signal which in turn may be provided to an output combiner that combines the anti-noise signal with the source audio signal to be reproduced by the transducer, as exemplified by combiner 26 of FIG. 2.

In operation, an increased gain of programmable gain element 46 may cause increased noise cancellation of the feedback anti-noise component, and a decreased gain may cause reduced noise cancellation of the feedback anti-noise component. In some embodiments, as described in greater detail below, oversight control 39, in conjunction with event detection block 38, may control the gain of programmable gain element 46 in response to detection of an ambient audio event that could cause feedback filter 44 to generate an undesirable component in the anti-noise signal in order to reduce the undesirable component.

Although feedback filter 44 and gain element 46 are shown as separate components of ANC circuit 30, in some embodiments some structure and/or function of feedback filter 44 and gain element 46 may be combined. For example, in some of such embodiments, an effective gain of feedback filter 44 may be varied via control of one or more filter coefficients of feedback filter 44. To the extent that gain element 46 has variable gain, feedback filter 44 in combination with gain element 46 may be considered an adaptive filter wherein the gain of gain element 46 is analogous to filter coefficients of feedback filter 44.

Event detection block 38 and oversight control block 39 may perform various actions in response to various events, as described in greater detail herein, including, without limitation, controlling the gain of programmable gain element 46. In some embodiments, event detection block 38 and oversight control block 39 may be similar in structure and/or functionality as the event detection and oversight control logic described in U.S. patent application Ser. No. 13/309,494 by Jon D. Hendrix et al., filed Dec. 1, 2011, entitled "Oversight Control of an Adaptive Noise Canceler in a Personal Audio Device," and assigned to the applicant of the present application.

In some embodiments, event detection block 38 may monitor signals within ANC circuit 30 (e.g., source audio signal ds/ia, a signal output by secondary estimate filter 34A, reference microphone signal ref, error microphone signal err, near speech signal ns, signals indicative of a status of W coefficient control block 31, and/or signals indicative of a status of SE coefficient control block 33) in order to detect a condition that triggers a reset of one or more adaptive filters of ANC circuit 30 (e.g., adaptive filter 32, adaptive filter 34A, and/or feedback filter 44). Conditions that may trigger a reset of one or more adaptive filters of ANC circuit 30 may include one or more of wind noise, scratching on a housing of the personal audio device, a substantially tonal ambient sound, a divergence of coefficients of the one or more adaptive filters, a signal level of the reference microphone signal falling outside of a predetermined range, and an excessive increase in a magnitude of filter coefficients.

Oversight control block 39 may be configured to receive from event detection block 38 an indication of an occurrence of a condition for triggering a reset of an adaptive filter and in response thereto, increment the coefficients of the adaptive filter in a plurality of steps from initial values of the coefficients at a time of triggering the reset to final values of the coefficients at a conclusion of the reset. In some embodiments, oversight control block 39 may be configured to increment the coefficients from the initial values to the final values by using a weighted moving average of the coefficients. In these and other embodiments, oversight control block 39 may be configured to increment the coefficients from the initial values to the final values by using an additive average of the coefficients. In these and other embodiments, oversight control block 39 may operate such that, in each of the plurality of steps, a degree of change of the coefficients during such step is set by a configurable smoothing factor, wherein the configurable smoothing factor is set by a type of the condition that triggers the reset. In these and other embodiments, oversight control block 39 may operate such that the plurality of steps occur over a configurable duration of time. In these and other embodiments, the final values of the coefficients may comprise a set of pre-determined coefficients (e.g., the set of pre-determined coefficients may include a set of zero values, a set of non-zero values, or a set with zero values and non-zero values). The functionality of event detection block 38 and oversight control block 39 may be further described with respect to FIG. 4 below.

Figure 4:
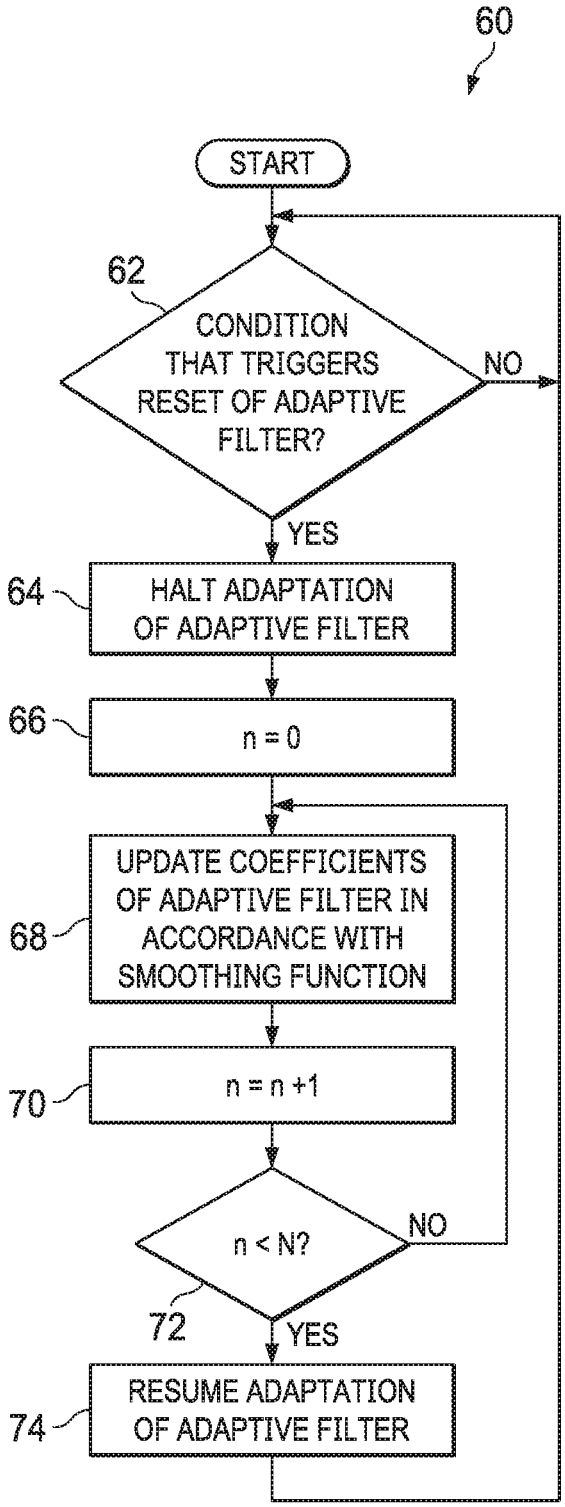
FIG. 4 is a flow chart of an example method for gradual resetting of filter coefficients in an ANC system, in accordance with embodiments of the present disclosure.

FIG. 4 is a flow chart of an example method 60 for gradual resetting of filter coefficients in an ANC system, in accordance with embodiments of the present disclosure. According to some embodiments, method 60 may begin at step 62. As noted above, teachings of the present disclosure are implemented in a variety of configurations of wireless telephone 10. As such, the preferred initialization point for method 60 and the order of the steps comprising method 60 may depend on the implementation chosen.

At step 62, event detection block 38 may monitor signals within ANC circuit 30 in order to detect a condition that triggers a reset of one or more adaptive filters of ANC circuit 30. If such a condition is detected, method 60 may proceed to step 64. Otherwise, method 60 may remain at step 62 until such a condition is detected.

In response to the occurrence of the condition, oversight control block 39 may begin a process of gradually resetting the adaptive filter, beginning at step 64. At step 64, in response to the occurrence of the condition, oversight control block 39 may halt adaptation of the adaptive filter (e.g., by holding coefficients of the adaptive filter constant). At step 66, oversight control block 39 may initialize a step counter n (e.g., by setting step counter n equal to zero).

At step 68, oversight control block 39 may update coefficients of the adaptive filter in accordance with a smoothing function. For example, at each time step n, each coefficient of an adaptive filter, y(n), may be incrementally updated to a new value, y(n+1), according to an exponential smoothing function: $y(n+1)=\alpha y(n)+(1-\alpha)x$, where x is a final target coefficient value and $\alpha$ is a configurable smoothing factor. Such final coefficient value x may be zero or a pre-configured value for the coefficient known to be "good." Configurable smoothing factor $\alpha$ may have a value between zero and one, and may define a rate of change towards the final coefficient value.

At step 70, oversight control block 39 may increment step counter n (e.g., n=n+1). At step 72, oversight control block 39 may compare step counter n to a configurable maximum step value N. Maximum step value N may thus define a configurable duration for the gradual reset operation. If step counter n is less than maximum step value N, then method 60 may proceed again to step 68. Otherwise, method 60 may proceed to step 74.

At step 74, oversight control block 39 may allow adaption of the adaptive filter to resume. In some instances, such resumption will occur with the coefficients set to their final coefficient values. In other instances, such resumption will occur with the coefficients set to their values after the last execution of step 68. After completion of step 74, method 60 may return again to step 62.

Although FIG. 4 discloses a particular number of steps to be taken with respect to method 60, method 60 may be executed with greater or fewer steps than those depicted in FIG. 4. In addition, although FIG. 4 discloses a certain order of steps to be taken with respect to method 60, the steps comprising method 60 may be completed in any suitable order.

Method 60 may be implemented using wireless telephone 10 or any other system operable to implement method 60. In certain embodiments, method 60 may be implemented partially or fully in software and/or firmware embodied in computer-readable media and executable by a controller.

Thus, in accordance with method 60, over the duration of a gradual adaptive filter reset (wherein such duration may be configurable), each coefficient of the adaptive filter may be updated towards its final, target value with a small increment that is a function of its current and target value, such as weighted moving average or additive average, with associated tuning parameters (e.g., configurable smoothing factor $\alpha$) which may be used to control the extent of smoothing. Thus, in accordance with embodiments of the present disclosure, perceptible audio artifacts during a filter reset may be reduced or eliminated. Furthermore, a configurable smoothing rate and configurable reset duration allows the reset to be performed over time and beyond a single time sample.

This disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

All examples and conditional language recited herein are intended for pedagogical objects to aid the reader in understanding the invention and the concepts contributed by the inventor to furthering the art, and are construed as being without limitation to such specifically recited examples and conditions. Although embodiments of the present inventions have been described in detail, it should be understood that various changes, substitutions, and alterations could be made hereto without departing from the spirit and scope of the disclosure.

What is claimed is:

1. An integrated circuit for implementing at least a portion of a personal audio device, comprising:

an output for providing a signal to a transducer, the signal including both a source audio signal for playback to a listener and an anti-noise signal for countering, in an acoustic output of the transducer, effects of ambient audio sounds;

an error microphone input for receiving an error microphone signal indicative of the output of the transducer and the ambient audio sounds at the transducer; and a processing circuit configured to:

implement an adaptive filter having a response configured to generate the anti-noise signal to reduce the presence of the ambient audio sounds at the error microphone;

implement a coefficient control block configured to shape the response of the adaptive filter in conformity with the error microphone signal by computing coefficients that determine the response of the adaptive filter to minimize the ambient audio sounds at the error microphone; and responsive to detecting a condition that triggers a reset of the adaptive filter, gradually reset the coefficients by changing the coefficients in a plurality of steps from initial values of the coefficients at a time of triggering the reset to final values of the coefficients at a conclusion of the reset, wherein the resetting is carried out such that in each of the plurality of steps, a degree of change of the coefficients during such step is set by a configurable smoothing factor that is set by a type of the condition that triggers the reset, and wherein the resetting is sufficiently gradual as to prevent the reset from generating an audible artifact in the signal provided to the transducer.

2. The integrated circuit of claim 1, wherein the condition comprises one or more of wind noise, scratching on a housing of the personal audio device, a substantially tonal ambient sound, a divergence of the coefficients, and an excessive increase in a magnitude of the coefficients.

3. The integrated circuit of claim 1, wherein the adaptive filter comprises a feedback filter that generates at least a portion of the anti-noise signal by applying the response of the adaptive filter to the error microphone signal.

4. The integrated circuit of claim 1, wherein:

the adaptive filter comprises a secondary path estimate filter configured to model an electro-acoustic path of the source audio signal and have a response that generates a secondary path estimate from the source audio signal; and the coefficient control block comprises a secondary path estimate coefficient control block that shapes the response of the secondary path estimate filter in conformity with the source audio signal and a playback corrected error by adapting the response of the secondary path estimate filter to minimize the playback corrected error, wherein the playback corrected error is based on a difference between the error microphone signal and the secondary path estimate.

5. The integrated circuit of claim 1, wherein:

the integrated circuit further comprises a reference microphone input for receiving a reference microphone signal indicative of the ambient audio sounds;

the adaptive filter comprises a feedforward filter having a response that generates the anti-noise signal from the reference microphone signal to reduce the presence of the ambient audio sounds heard by the listener; and the coefficient control block comprises a feedforward coefficient control block that shapes the response of the adaptive filter in conformity with the error microphone signal and the reference microphone signal to minimize the ambient audio sounds at the error microphone.

6. The integrated circuit of claim 5, wherein the condition comprises one or more of wind noise, scratching on a housing of the personal audio device, a substantially tonal ambient sound, a divergence of the coefficients, a signal level of the reference microphone signal falling outside of a predetermined range, and an excessive increase in a magnitude of the coefficients.

7. The integrated circuit of claim 1, wherein the processing circuit is configured to change the coefficients from the initial values to the final values by using a weighted moving average of the coefficients.

8. The integrated circuit of claim 1, wherein the processing circuit is configured to change the coefficients from the initial values to the final values by using an additive average of the coefficients.

9. The integrated circuit of claim 1, wherein the plurality of steps occur over a configurable duration of time.

10. The integrated circuit of claim 1, wherein the final values of the coefficients comprise a set of pre-determined coefficients.

11. The integrated circuit of claim 10, wherein the set of pre-determined coefficients comprises a set of zero values.

12. A method comprising:

receiving an error microphone signal indicative of an output of a transducer and ambient audio sounds at the transducer;

generating an anti-noise signal for countering, in an acoustic output of the transducer, effects of ambient audio sounds, wherein generating the anti-noise signal comprises:

implementing an adaptive filter having a response that generates the anti-noise signal to reduce the presence of the ambient audio sounds in the error microphone signal; and implementing a coefficient control block that shapes the response of the adaptive filter in conformity with the error microphone signal by computing coefficients that determine the response of the adaptive filter to minimize the ambient audio sounds at the error microphone;

responsive to detecting a condition that triggers a reset of the adaptive filter, gradually resetting the coefficients by changing the coefficients in a plurality of steps from initial values of the coefficients at a time of triggering the reset to final values of the coefficients at a conclusion of the reset; and combining the anti-noise signal with a source audio signal to generate an audio signal provided to the transducer, wherein the resetting is carried out such that in each of the plurality of steps, a degree of change of the coefficients during such step is set by a configurable smoothing factor that is set by a type of the condition that triggers the reset, and wherein the resetting is sufficiently gradual as to prevent the reset from generating an audible artifact in the audio signal provided to the transducer.

13. The method of claim 12, wherein the condition comprises one or more of wind noise, scratching on a housing of a personal audio device, a substantially tonal ambient sound, a divergence of the coefficients, and an excessive increase in a magnitude of the coefficients.

14. The method of claim 12, wherein the adaptive filter comprises a feedback filter that generates at least a portion of the anti-noise signal by applying the response of the adaptive filter to the error microphone signal.

15. The method of claim 12, wherein:

the adaptive filter comprises a secondary path estimate filter configured to model an electro-acoustic path of the source audio signal and have a response that generates a secondary path estimate from the source audio signal; and the coefficient control block comprises a secondary path estimate coefficient control block that shapes the response of the secondary path estimate filter in conformity with the source audio signal and a playback corrected error by adapting the response of the secondary path estimate filter to minimize the playback corrected error, wherein the playback corrected error is based on a difference between the error microphone signal and the secondary path estimate.

16. The method of claim 12, further comprising receiving a reference microphone signal indicative of the ambient audio sounds, wherein:

the adaptive filter comprises a feedforward filter having a response that generates the anti-noise signal from the reference microphone signal to reduce the presence of the ambient audio sounds heard by a listener; and the coefficient control block comprises a feedforward coefficient control block that shapes the response of the adaptive filter in conformity with the error microphone signal and the reference microphone signal to minimize the ambient audio sounds at the error microphone.

17. The method of claim 16, wherein the condition comprises one or more of wind noise, scratching on a housing of a personal audio device, a substantially tonal ambient sound, a divergence of the coefficients, a signal level of the reference microphone signal falling outside of a predetermined range, and an excessive increase in a magnitude of the coefficients.

18. The method of claim 12, further comprising changing the coefficients from the initial values to the final values by using a weighted moving average of the coefficients.

19. The method of claim 12, further comprising changing the coefficients from the initial values to the final values by using an additive average of the coefficients.

20. The method of claim 12, wherein the plurality of steps occur over a configurable duration of time.

21. The method of claim 12, wherein the final values of the coefficients comprise a set of pre-determined coefficients.

22. The method of claim 21, wherein the set of pre-determined coefficients comprises a set of zero values.

* * * * *